US010196075B2

(12) United States Patent
Wang et al.

(10) Patent No.: US 10,196,075 B2
(45) Date of Patent: Feb. 5, 2019

(54) RAILWAY VEHICLE AND AXLE BOX STRUCTURE THEREOF

(71) Applicant: CRRC QINGDAO SIFANG CO., LTD., Qingdao, Shandong (CN)

(72) Inventors: Peidong Wang, Shandong (CN); Pingyu Zhou, Shandong (CN); Xiaojiang Zhou, Shandong (CN); Xiaojun Lv, Shandong (CN); Daqiang Wang, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 261 days.

(21) Appl. No.: 15/112,989

(22) PCT Filed: Nov. 16, 2015

(86) PCT No.: PCT/CN2015/094661
§ 371 (c)(1),
(2) Date: Jul. 20, 2016

(87) PCT Pub. No.: WO2016/112738
PCT Pub. Date: Jul. 21, 2016

(65) Prior Publication Data

US 2018/0170410 A1 Jun. 21, 2018

(30) Foreign Application Priority Data

Jan. 16, 2015 (CN) ..... 2015 1 0021416
Jan. 16, 2015 (CN) ..... 2015 2 0029183 U

(51) Int. Cl.
*B61F 15/26* (2006.01)
*B61F 15/12* (2006.01)
(Continued)

(52) U.S. Cl.
CPC ..... *B61F 15/26* (2013.01); *B61F 5/26* (2013.01); *B61F 15/12* (2013.01); *B61F 15/00* (2013.01)

(58) Field of Classification Search
CPC ..... B61F 15/04; B61F 15/12; B61F 15/20; B61F 15/26; B61F 5/26; B61F 5/28; B61F 5/30; B61F 5/32
See application file for complete search history.

(56) References Cited

U.S. PATENT DOCUMENTS 1,253,478 A * 1/1918 Duncan ..... B61F 15/00 295/42
1,730,933 A * 10/1929 Hennessy ..... B61F 15/04 384/167
(Continued)

FOREIGN PATENT DOCUMENTS

CN 200992006 Y 12/2007
CN 201193037 Y 2/2009
(Continued)

OTHER PUBLICATIONS

Summary of the Chinese 2nd Office Action for CN201510021416.6, dated Apr. 14, 2017.
(Continued)

*Primary Examiner* — Kip T Kotter
(74) *Attorney, Agent, or Firm* — U.S. Fairsky LLP; Yue (Robert) Xu

(57) ABSTRACT

A railway vehicle and an axle box structure thereof are provided. The axle box structure includes an axle box body and a positioning node mounting seat. The axle box body includes an upper box body and a lower box body. The upper box body and the lower box body enclose a bearing mounting chamber together. A lower end surface of the upper box body has a convex portion, and an upper end surface of the lower box body has a concave portion. A first semi-circular
(Continued)

hole and a second semi-circular hole are respectively provided at the middle of the upper box body and the lower box body. If the convex portion and the concave portion are assembled in a sealed coupling manner, the bearing mounting chamber is formed by the first semi-circular hole and the second semi-circular hole.

14 Claims, 4 Drawing Sheets

(51) Int. Cl.
*B61F 5/26* (2006.01)
*B61F 15/00* (2006.01)

(56) References Cited

U.S. PATENT DOCUMENTS 9,670,962 B2 * 6/2017 Le Moigne ..... F16C 43/00
9,744,976 B2 * 8/2017 Wang ..... B61F 5/325
2004/0123769 A1 7/2004 Nishimura
2013/0161969 A1 * 6/2013 Le Moigne ..... B61F 15/12 295/36.1
2016/0320229 A1 * 11/2016 Nishimura ..... G01G 19/042

FOREIGN PATENT DOCUMENTS

CN 202193087 U 4/2012
CN 202428214 U 9/2012
CN 203623702 U 6/2014
CN 104608789 A 5/2015
CN 104691570 A 6/2015
CN 204488814 U 7/2015
CN 204488815 U 7/2015
JP H10278791 A 10/1998
KR 100831656 B1 5/2008
KR 20120119377 A 10/2012

OTHER PUBLICATIONS

Chinese First Office Action for CN201510021416.6, dated Aug. 23, 2016.
International Search Report for PCT/CN2015/094661, dated Feb. 4, 2016, ISA/CN.

* cited by examiner

RAILWAY VEHICLE AND AXLE BOX STRUCTURE THEREOF

This application is a National Phase entry of PCT Application No. PCT/CN2015/094661, filed Nov. 16, 2015, which claims the benefit of priorities to Chinese Patent Application No. 201510021416.6 titled "RAILWAY VEHICLE AND AXLE BOX STRUCTURE THEREOF", filed with the Chinese State Intellectual Property Office on Jan. 16, 2015, and Chinese Patent Application No. 201520029183.X titled "RAILWAY VEHICLE AND AXLE BOX STRUCTURE THEREOF", filed with the Chinese State Intellectual Property Office on Jan. 16, 2015, the entire disclosures of which are incorporated herein by reference.

FIELD

The present application relates to the technical field of railway vehicles, and particularly to a railway vehicle and an axle box structure of the railway vehicle.

BACKGROUND

An axle box structure is a movable joint connecting a frame and a wheel set. Besides transmitting forces and vibrations in all directions, the axle box structure must ensure the wheel set to adapt to traveling line conditions and jump up and down and move left and right with respect to the frame.

The axle box structure is an important part connecting wheel set and frame. The axle box structure generally has a rocker type structure and a tension bar type structure. Currently, most of railway vehicles employ the rocker type axle box structure. The rocker type axle box structure includes an axle box and a rocker integrated with each other, that is, the rocker type axle box. The rocker type axle box includes an axle box body and a positioning node mounting seat. A bearing is provided in the axle box body. An end of a railway vehicle axle is disposed within the axle box by the bearing. An axle box spring is provided between an upper end surface of the axle box body and the frame of a bogie. A vertical damper mounting seat, which is configured to mount one end of the vertical damper, is further provided on an outer wall of the axle box body. Another end of the vertical damper is connected to the frame. The positioning node mounting seat is configured to mount a positioning node, which is configured to transmit a tractive force and a braking force between the wheel set and the frame.

Currently, a brake disc is further mounted on the railway vehicle axle near an inner side of the wheel set. A brake caliper for controlling the brake disc is further mounted on the frame. The wheel set and the brake disc are required to be removed and replaced quickly from the axle in the later using process. The rocker type axle box is mounted on an outer side of the wheel set, that is, too many parts and components installed are mounted near the wheel set. However, due to a limit space below the railway vehicle, components such as the rocker type axle box, the brake disc, the brake caliper may only be arranged in the limit space. That is, structures of the components described above directly affect assembly relationship between the components, even the performance of whole vehicle. Therefore, the position relationship between the rocker type axle box, the brake disc and the brake caliper has been optimized by those skilled in the art continuously.

Therefore, a technical issue to be addressed presently by those skilled in the art is to optimize the structure of the rocker axle box, optimize the whole vehicle layout, and increase the efficiency of replacing the wheel set based on the status of the vehicle body.

SUMMARY

An object of the present application is to provide a railway vehicle and an axle box structure in which the specific structure of the axle box structure is changed, thus the arrangement of components below the railway vehicle is further optimized, and the efficiency of replacing a wheel set may be increased.

An axle box structure for a railway vehicle is provided according to the present application, which includes an axle box body and a positioning node mounting seat. A bearing mounting chamber is provided in the axle box body. The positioning node mounting seat is provided with a mounting chamber for mounting a positioning node. The axle box body is a separated structure which includes an upper box body and a lower box body cooperated in a sealed manner with each other. The upper box body and the lower box body enclose the bearing mounting chamber together. The upper box body and the lower box body are connected by a bolt, and the positioning node mounting seat is integrally formed with the upper box body.

A lower end surface of the upper box body has a convex portion extending downwardly at each of two outer lateral edges in an axial direction, and an upper end surface of the lower box body has a concave portion concaved downwardly at each of two outer lateral edges. A first semi-circular hole and a second semi-circular hole are respectively provided at the middle of the upper box body and the lower box body. If the convex portion and the concave portion are assembled in a sealed coupling manner, the bearing mounting chamber is formed by the first semi-circular hole and the second semi-circular hole.

Preferably, the convex portion further has a first boss extending outwardly, and the concave portion has a second boss extending outwardly. The first boss is provided with an internal threaded hole, and the second boss is provided with a through hole. The upper box body and the lower box body are fixedly connected to each other by a bolt arranged in both the through hole and the internal threaded hole.

Preferably, in the axial direction, each of two ends of the first boss has an extended portion extending outwardly, and each of the two extended portions is provided with a vertical damper mounting seat in cooperation with a vertical damper of the railway vehicle.

Preferably, the axle box structure for the railway vehicle further includes a positioning pin. The positioning pin includes a large diameter section at a middle portion and a small diameter section located at each of two ends of the large diameter section, and a countersink is further provided on an upper end surface of the second boss, and the height of the large diameter section is lower than the height of a large hole of the countersink. A positioning hole is also provided at a matching position of a lower end surface of the first boss. When the upper box body is assembled in cooperation with the lower box body. The two small diameter sections are respectively arranged in the small hole of the countersink and in the positioning hole.

Preferably, a wheel set lifting seat is further provided on an outer wall of the upper box body. The wheel set lifting seat is provided with a vertical lifting hole. A railway guard mounting seat for mounting and fixing a railway guard of the railway vehicle is further provided at a bottom of an outer wall of the lower box body.

Preferably, ends of the upper box body and the lower box body connecting to an end cover are further respectively provided with a first drain groove and a second drain groove in a circumferential direction, and if the upper box body and the lower box body are assembled, the first drain groove and the second drain groove form an annular groove.

Preferably, the positioning node mounting seat is a separated structure which includes a left mounting seat and a right mounting seat. The left mounting seat is integrally formed with the upper box body. Each of the left mounting seat and the right mounting seat has an inwardly recessed portion. If the left mounting seat and the right mounting seat are fixed to each other, the two recessed portions form a mounting cavity for the positioning node.

Preferably, a box body wall of the lower box body is provided with an oil drain hole, and a removable plug is provided in the oil drain hole.

Herein, the upper box body and the lower box body which are separated are connected in a sealed coupling manner, which facilitating forming a sealed bearing mounting chamber, thereby improving the reliability of bearing mounting. Also, when the wheel set is removed, only the lower box body is required to be removed, a quick removal of the wheel set is realized, thereby improving the efficiency of replacing the wheel set.

A railway vehicle is further provided according to the present application, which includes a wheel set, a frame and an axle box structure, according to any one of the above items, mounted between the wheel set and the frame. The frame is provided with a side beam for mounting the positioning node cooperatively.

Since the railway vehicle has the above axle box structure, the railway vehicle also has the above technical effects of the axle box structure.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are some examples of the present application, and for those skilled in the art, other drawings may be obtained based on these drawings without any creative efforts.

Figure 1:
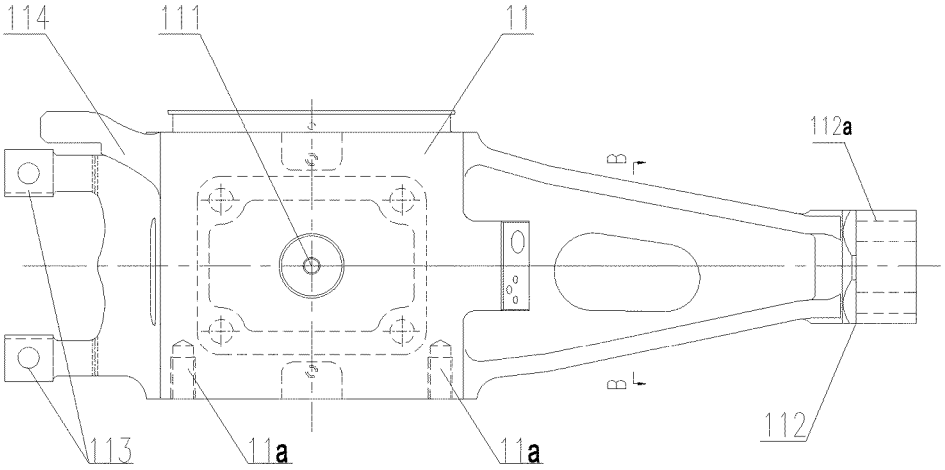
FIG. 1 is a schematic view showing the structure of an axle box structure according to an embodiment of the present application.

In the drawings, correspondences between components and reference numerals in FIGS. 1 to 5 are as follows:

| | | | |
|---|---|---|---|
| 11 | upper box body, | 1a | bearing mounting chamber, |
| 11a | threaded hole, | 11c | first drain groove, |
| 12c | second drain groove, | 111 | spring mounting seat, |
| 111a | threaded hole, | 112 | positioning node mounting seat, |
| 112a | mounting hole, | 113 | vertical damper mounting seat, |
| 114 | wheel set lifting seat, | 115a | threaded hole, |

-continued

| | | | |
|---|---|---|---|
| 116 | convex portion, | 115 | first boss, |
| 122 | second boss, | 12 | lower box body, |
| 12b | oil drain hole, | 121 | rail guard mounting seat, |
| 122 | boss, | 122a | through hole, |
| 123 | concave portion, | 13 | rocker, |
| 14 | positioning pin, | 141 | large diameter section, |
| 142 | first small diameter section, | 143 | second small diameter section, |
| 131 | first semi-circular hole, | 132 | second semi-circular hole, |
| 151 | left mounting seat, | 17 | recessed portion, |

DETAILED DESCRIPTION

For the objects, technical solutions, and advantages of the present application to be clearer, the technical solutions in the embodiments of the present application will be described clearly and completely hereinafter in conjunction with the drawings in the embodiments of the present application. Apparently, the described embodiments are a part of the embodiments of the present application, rather than all embodiments. Based on the embodiments in the present application, all of other embodiments, made by those skilled in the art without any creative efforts, fall into the scope of the present application.

A core of the present application is to provide a railway vehicle and an axle box structure, in which, the specific structure of the axle box structure is changed and thus the arrangement of components below the railway vehicle is further optimized, and the efficiency of replacing a wheel set is increased.

Figure 2:
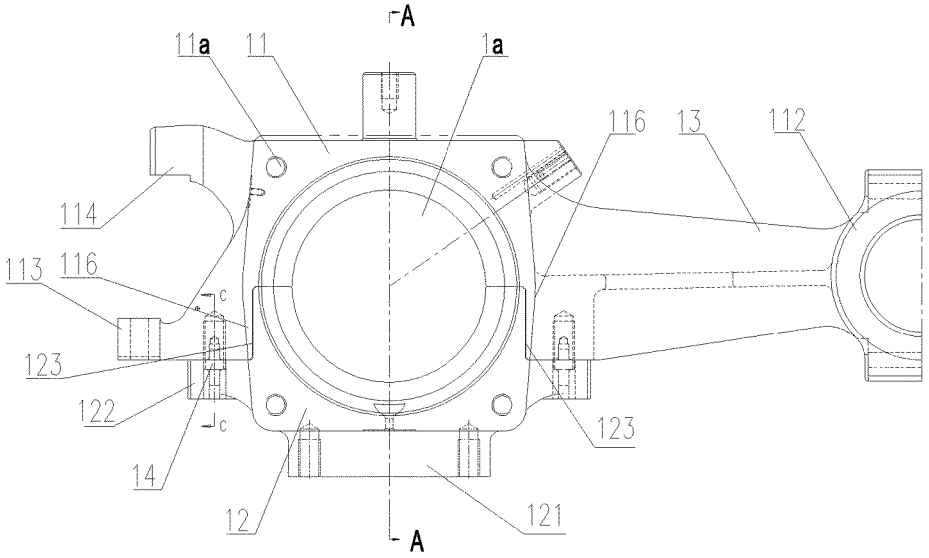
FIG. 2 is a top view of the axle box structure in FIG. 1.
Figure 3:
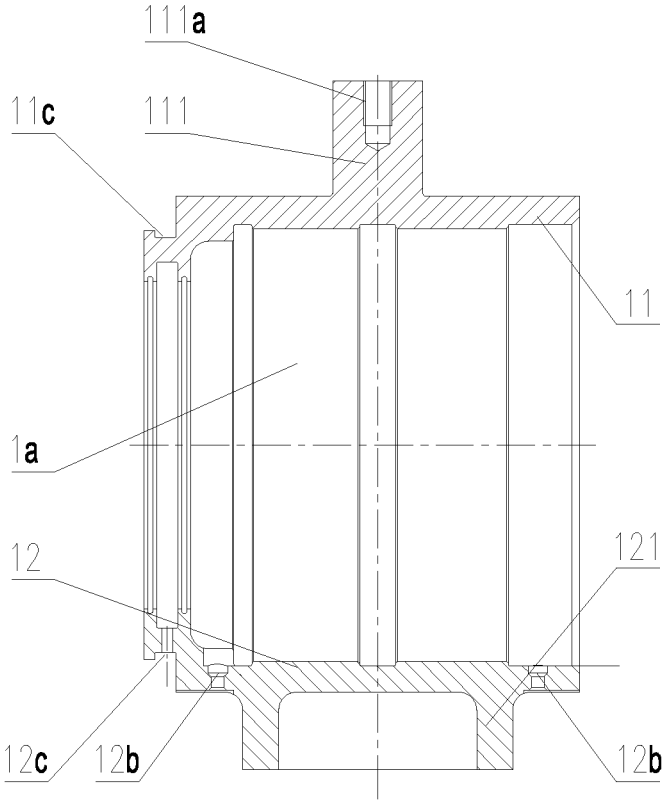
FIG. 3 is a view taken along A-A in FIG. 2.

Reference is made to FIGS. 1 to 2, FIG. 1 is a schematic view showing the structure of an axle box structure according to an embodiment of the present application. FIG. 2 is a top view of the axle box structure in FIG. 1. FIG. 3 is a view taken along A-A in FIG. 2.

An axle box structure for a railway vehicle is provided according to the present application, which includes an axle box body and a positioning node mounting seat 112. A bearing mounting chamber 1*a* is provided in the axle box body. A bearing is mounted in the bearing mounting chamber 1*a*. An end portion of a railway vehicle axle, provided with a wheel set, is disposed in the bearing mounting chamber 1*a* of the axle box body via the bearing. In order to protect the bearing from being affected by an external environment, a front end cover and a rear end cover are further provided respectively on two sides of the bearing mounting chamber 1*a* of the axle box body. An axle box spring mounting seat 111 for mounting an axle box spring is further provided on an upper end surface of the axle box body. Accordingly, a frame is provided with a spring cartridge. The axle box spring is disposed in the spring cartridge. Generally, the axle box spring mounting seat 111 is provided with a threaded hole 111*a* for fixing the spring cartridge.

The positioning node mounting seat 112 is provided with a mounting chamber for mounting a positioning node. The positioning node is configured to transmit a tractive force and a braking force between the wheel set 20 and the frame. Herein, the axle box body may include an upper box body 11 and a lower box body 12 cooperated with each other in a sealed manner. The upper box body 11 and the lower box body 12 enclose the bearing mounting chamber 1*a* together and are connected by a bolt. The positioning node mounting seat 112 is integrally formed with the upper box body 11.

In this way, when the wheel set is replaced, only the lower box body 12, as well as related components in connection with the lower box body 12, is required to be removed from the upper box body 11, and there is no need to remove the entire axle box body, which greatly improves the efficiency of replacing the wheel set.

For the specific connection structure of the upper box body 11 and the lower box body 12, specific structures of the upper box body 11 and the lower box body 12 are given as follows.

In a specific embodiment, a lower end surface of the upper box body 11 has a convex portion 116 extending downwardly at each of two outer lateral edges in an axial direction, and an upper end surface of the lower box body 12 has a concave portion 123 concaved downwardly at each of two outer lateral edges in the axial direction. A first semi-circular hole 131 and a second semi-circular hole 132 are respectively provided at the middle of the upper box body 11 and the lower box body 12. If the convex portion 116 and the concave portion 123 are assembled in a sealed coupling manner, the bearing mounting chamber 1*a* is formed by the first semi-circular hole 131 and the second semi-circular hole 132. It needs to be noted that the axial direction mentioned above refers to an axis direction of the railway vehicle axle when the axle box body and the wheel set are in an assembled position.

A sealing ring and so on may be provided between the upper box body 11 and the lower box body 12 to achieve sealing, which facilitates improving the tightness of the bearing mounting chamber 1*a*. The upper box body 11 and the lower box body 12 may be provided with a labyrinth sealing structure and a gap sealing structure to ensure the tightness.

Herein, the upper box body and the lower box body, which are separated, are connected in the sealed coupling manner, which facilitates forming a sealed bearing mounting chamber, thereby improving the reliability of mounting of the bearing. Further, when the wheel set is required to be removed, only the lower box body is required to be removed. A quick removal of the wheel set may just be achieved, which improves the efficiency of replacing the wheel set.

Figure 4:
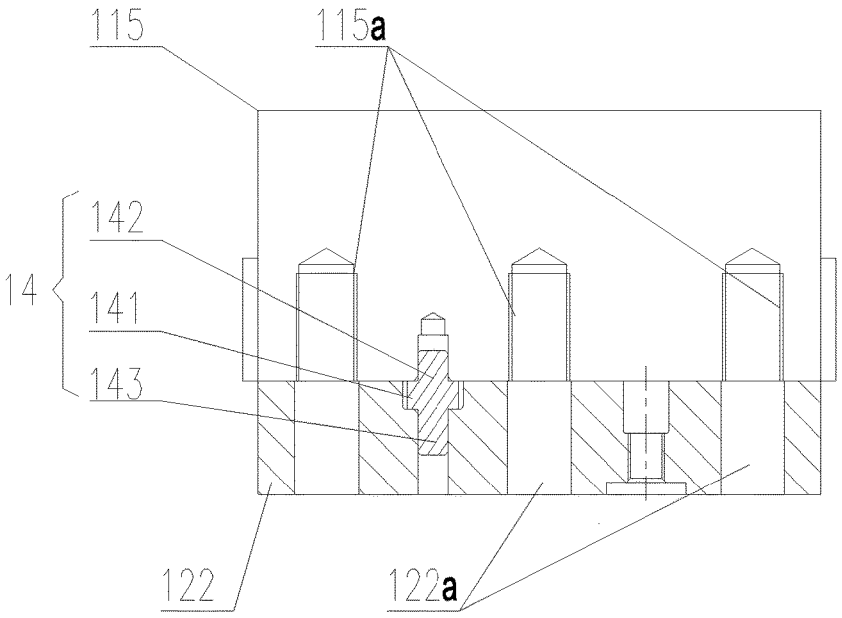
FIG. 4 is a view taken along C-C in FIG. 2.

Reference is made to FIG. 4, which is a view taken along C-C in FIG. 2.

Specifically, the convex portion 116 may further have a first boss 115 extending outwardly, and the concave portion 123 has a second boss 122 extending outwardly. The first boss 115 is provided with an internal threaded hole 115*a*, and the second boss 122 is provided with a through hole 122*a*. The upper box body 11 is fixedly connected to the lower box body 12 by a bolt arranged in both the through hole 122*a* and the internal threaded hole 115*a*. When the axle box body of this structure is assembled, a threaded portion of a screw or a bolt passes through the through hole 122*a* of the second boss 122 from down to up and is screwed into the internal threaded hole 115*a* of the first boss 115, realizing a reliable assembly of the first boss 115 and the second boss 122.

In a specific embodiment, in the axial direction, each of two ends of the first boss 115 has an extended portion extending outwardly, and the extended portion is provided with a vertical damper mounting seat 113 in cooperation with a vertical damper of the railway vehicle. In this embodiment, the vertical damper mounting seat 113 is integrally formed with the upper box body 11 without subsequent assembly, which not only simplifies the machining process of the axle box body, but also improves the use intensity of the axle box body.

Apparently, the vertical damper mounting seat 113 may also be provided on the lower box body 12. For example, each of two ends of the second boss 122 has an extended portion extending outwardly, and the extending portion is provided with the vertical damper mounting seat 113 in cooperation with the vertical damper of the railway vehicle.

For facilitating assembling the upper box body 11 and the lower box body 12, the axle box structure in the above embodiments may further includes a positioning pin 14. The positioning pin 14 includes a large diameter section 141 at a middle portion and a small diameter section located at either end of the large diameter section 141. A countersink is further provided on an upper end surface of the second boss 122. The countersink includes a large diameter hole having a larger diameter and a small diameter hole having a smaller diameter, and the height of the large diameter section 141 is lower than the height of the large diameter hole of the countersink. A positioning hole is also provided at a matching position of a lower end surface of the first boss 115. When the upper box body 11 is assembled in cooperation with the lower box body 12, two small diameter sections are respectively disposed in the small diameter hole of the countersink and in the positioning hole. Herein, the two small diameter sections are defined as a first small diameter section 142 and a second small diameter section 143. The first small diameter section 142 and the second small diameter section 143 are respectively fitted with the positioning hole of the first boss 115 and the small diameter hole of the countersink. The fit may be a clearance fit or may be an interference fit.

In this way, when the upper box body 11 and the lower box body 12 is assembled, it may firstly arrange the second small diameter section 143 of the positioning pin 14 in the small diameter hole of the countersink of the second boss 122, then achieve a quick and accurate positioning of the upper box body 11 and the lower box body 12, and then fix the upper box body 11 and the lower box body 12 with each other by a bolt.

In the above embodiments, a wheel set lifting seat may be further provided on an outer wall of the upper box body 11. The wheel set lifting seat is provided with a vertical lifting hole. A rail guard mounting seat 121 for mounting and fixing a rail guard of the railway vehicle is further provided at a bottom of an outer wall of the lower box body 12. Reference for the specific structure of the rail guard mounting seat 121 may be made to FIG. 3.

Figure 5:
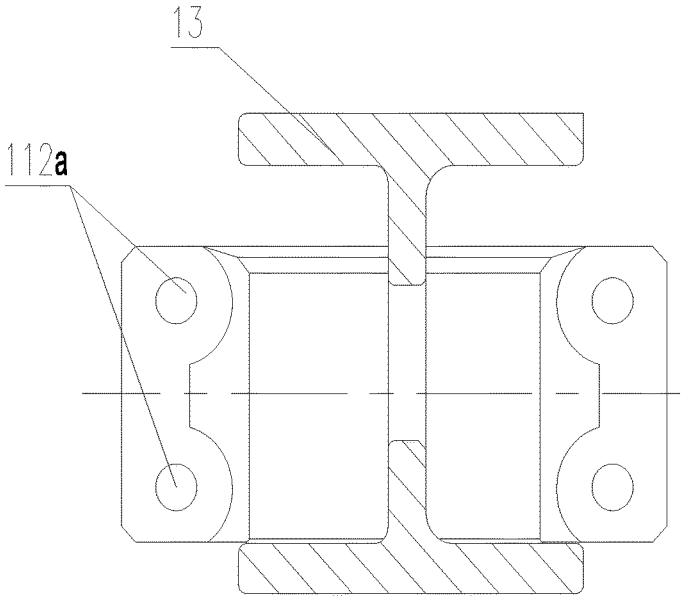
FIG. 5 is a view taken along B-B in FIG. 1.
Figure 6:
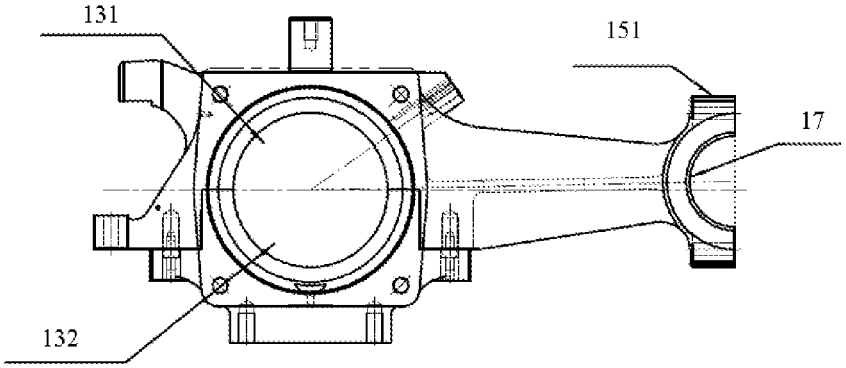
FIG. 6 is a schematic view showing the structure of an axle box structure having a first semi-circular hole, a second semi-circular hole, a left mounting seat, and a recessed portion.

Reference is made to FIG. 5, which is a view taken along B-B in FIG. 1. Only a left mounting seat is shown in FIGS. 1 and 2, and a right mounting seat is not shown.

Further, for facilitating a quick removing of the positioning node, the positioning node mounting seat 112 includes a left mounting seat 151 and a right mounting seat. The left mounting seat 151 is integrally formed with the upper box body 11. Each of the left mounting seat 151 and the right mounting seat has an inwardly recessed portion 17. If the left mounting seat 151 and the right mounting seat are fixed with each other, the two recessed portions 17 form a mounting cavity for the positioning node. The left mounting seat 151 and right mounting seat are connected by a bolt. Reference for a specific arrangement of a mounting hole 112*a* of the left mounting seat 151 may be made to FIG. 5.

In the above embodiments, ends of the upper box body 11 and the lower box body 12 connecting to the end covers are further respectively provided with a first drain groove 11*c* and a second drain groove 12*c* in a circumferential direction. If the upper box body 11 and the lower box body 12 are assembled, the first drain groove 11*c* and the second drain groove 12*c* form an annular groove. This arrangement may prevent water and other liquids from directly entering an inside of the axle box body.

The lower box body 12 is further provided with an oil drain hole 12*b*. The testing oil, bearing grease and the like may be discharged without disassembling other components, thereby improving the work efficiency.

Based on the above axle box structure, a railway vehicle is further provided herein, which includes a wheel set, a frame and an axle box structure mounted between the wheel set and the frame according to any one of the above embodiments.

Because the railway vehicle has the above axle box structure, the railway vehicle also has the above technical effects of the axle box structure.

A railway vehicle and the axle box structure of the railway vehicle according to the present application are described in detail hereinbefore. The principle and the embodiments of the present application are illustrated herein by specific examples. The above description of examples is only intended to help the understanding of the method and the spirit of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. An axle box structure for a railway vehicle, comprising an axle box body and a positioning node mounting seat, wherein a bearing mounting chamber is provided in the axle box body, the positioning node mounting seat is provided with a mounting chamber for mounting a positioning node, wherein the axle box body is a separated structure which comprises an upper box body and a lower box body cooperated in a sealed manner, the upper box body and the lower box body enclose the bearing mounting chamber together, and the upper box body and the lower box body are connected by a bolt, the positioning node mounting seat is integrally formed with the upper box body, a lower end surface of the upper box body has a convex portion extending downwardly at each of two outer lateral edges in an axial direction, an upper end surface of the lower box body has a concave portion concaved downwardly at each of two outer lateral edges, a first semi-circular hole and a second semi-circular hole are respectively provided at the middle of the upper box body and the lower box body, and if the convex portion and the concave portion are assembled in a sealed coupling manner, the bearing mounting chamber is formed by the first semi-circular hole and the second semi-circular hole, and a wheel set lifting seat is further provided on an outer wall of the upper box body, the wheel set lifting seat is provided with a vertical lifting hole, a railway guard mounting seat for mounting and fixing a railway guard of the railway vehicle is further provided at a bottom of an outer wall of the lower box body.

2. The axle box structure for the railway vehicle according to claim 1, wherein the convex portion further has a first boss extending outwardly, the concave portion has a second boss extending outwardly, the first boss is provided with an internal threaded hole, and the second boss is provided with a through hole, the upper box body and the lower box body are fixedly connected to each other by a bolt arranged in both the through hole and the internal threaded hole.

3. The axle box structure for the railway vehicle according to claim 2, wherein in the axial direction, each of two ends of the first boss has an extended portion extending outwardly, each of the two extended portions is provided with a vertical damper mounting seat in cooperation with a vertical damper of the railway vehicle.

4. The axle box structure for the railway vehicle according to claim 3, further comprising a positioning pin, wherein the positioning pin comprises a large diameter section at a middle portion and a small diameter section at each of two ends of the large diameter section, and a countersink is further provided on an upper end surface of the second boss, and the height of the large diameter section is lower than the height of a large hole of the countersink, a positioning hole is also provided at a matching position of a lower end surface of the first boss, and when the upper box body is assembled in cooperation with the lower box body, the two small diameter sections are respectively arranged in the small hole of the countersink and in the positioning hole.

5. The axle box structure for the railway vehicle according to claim 4, wherein the positioning node mounting seat comprises a left mounting seat and a right mounting seat, and the left mounting seat is integrally formed with the upper box body, each of the left mounting seat and the right mounting seat has an inwardly recessed portion, and after the left mounting seat and the right mounting seat are fixed with each other, the two recessed portions form a mounting cavity for the positioning node.

6. The axle box structure for the railway vehicle according to claim 4, wherein a box body wall of the lower box body is provided with an oil drain hole, and a removable plug is provided in the oil drain hole.

7. The axle box structure for the railway vehicle according to claim 3, wherein the positioning node mounting seat comprises a left mounting seat and a right mounting seat, and the left mounting seat is integrally formed with the upper box body, each of the left mounting seat and the right mounting seat has an inwardly recessed portion, and after the left mounting seat and the right mounting seat are fixed with each other, the two recessed portions form a mounting cavity for the positioning node.

8. The axle box structure for the railway vehicle according to claim 3, wherein a box body wall of the lower box body is provided with an oil drain hole, and a removable plug is provided in the oil drain hole.

9. The axle box structure for the railway vehicle according to claim 2, wherein ends of the upper box body and the lower box body connecting to an end cover are further respectively provided with a first draining groove and a second draining groove in a circumferential direction, and after the upper box body and the lower box body are assembled, the first draining groove and the second draining groove form an annular groove.

10. The axle box structure for the railway vehicle according to claim 9, wherein the positioning node mounting seat comprises a left mounting seat and a right mounting seat, and the left mounting seat is integrally formed with the upper box body, each of the left mounting seat and the right mounting seat has an inwardly recessed portion, and after the left mounting seat and the right mounting seat are fixed with each other, the two recessed portions form a mounting cavity for the positioning node.

11. The axle box structure for the railway vehicle according to claim 9, wherein a box body wall of the lower box body is provided with an oil drain hole, and a removable plug is provided in the oil drain hole.

12. The axle box structure for the railway vehicle according to claim 2, wherein the positioning node mounting seat comprises a left mounting seat and a right mounting seat, and the left mounting seat is integrally formed with the upper box body, each of the left mounting seat and the right mounting seat has an inwardly recessed portion, and after the left mounting seat and the right mounting seat are fixed with each other, the two recessed portions form a mounting cavity for the positioning node.

13. The axle box structure for the railway vehicle according to claim 2, wherein a box body wall of the lower box body is provided with an oil drain hole, and a removable plug is provided in the oil drain hole.

14. A railway vehicle, comprising A railway vehicle, comprising:

a wheel set, a frame, and an axle box structure mounted between the wheel set and the frame according to claim 1, wherein the frame is provided with a side beam for mounting the positioning node cooperatively.

* * * * *